US007978156B2

(12) United States Patent
Kim

(10) Patent No.: US 7,978,156 B2
(45) Date of Patent: Jul. 12, 2011

(54) PIXEL CIRCUIT OF ORGANIC ELECTROLUMINESCENT DISPLAY DEVICE AND METHOD OF DRIVING THE SAME

(75) Inventor: Yang-Wan Kim, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 880 days.

(21) Appl. No.: 11/504,830

(22) Filed: Aug. 15, 2006

(65) Prior Publication Data

US 2007/0040772 A1 Feb. 22, 2007

(30) Foreign Application Priority Data

Aug. 22, 2005 (KR) ..... 10-2005-0076994

(51) Int. Cl.
*G09G 3/30* (2006.01)
*G09G 3/10* (2006.01)

(52) U.S. Cl. ..... 345/76; 345/77; 345/80; 315/169.3

(58) Field of Classification Search ..... 345/76–81; 315/169.3

See application file for complete search history.

(56) References Cited

U.S. PATENT DOCUMENTS

| | | | | |
|---|---|---|---|---|
| 6,919,871 | B2 * | 7/2005 | Kwon | 345/92 |
| 2003/0197663 | A1 * | 10/2003 | Lee et al. | 345/76 |
| 2004/0056828 | A1 * | 3/2004 | Choi et al. | 345/82 |
| 2005/0243036 | A1 * | 11/2005 | Ikeda | 345/76 |

FOREIGN PATENT DOCUMENTS

EP 1 465 143 B1 * 11/2003

* cited by examiner

*Primary Examiner* — Sumati Lefkowitz
*Assistant Examiner* — Jonathan Horner
(74) *Attorney, Agent, or Firm* — Christie, Parker & Hale, LLP

(57) ABSTRACT

A pixel circuit of an organic electroluminescent display device and a method of driving the same. In the pixel circuit, a capacitor has a first electrode connected to a gate of a driving transistor, and a second electrode connected to a drain of a switching transistor. Further, a compensation voltage applying transistor is connected to the second electrode of the capacitor. The compensation voltage applying transistor compensates for a difference in IR-drops of a power supply voltage in response to a previous emission control signal. Further, the compensation voltage applying transistor cuts off the compensation voltage in an initialization period, thereby preventing a source of a data voltage and a source of the compensation voltage from being shorted with each other. Additionally, a threshold voltage compensation transistor is connected between the gate and the drain of the driving transistor. Therefore, a difference in threshold voltages of driving transistors is compensated.

13 Claims, 6 Drawing Sheets

PIXEL CIRCUIT OF ORGANIC ELECTROLUMINESCENT DISPLAY DEVICE AND METHOD OF DRIVING THE SAME

CROSS-REFERENCE TO RELATED APPLICATION

This application claims priority to and the benefit of Korean Patent Application No. 10-2005-0076994, filed Aug. 22, 2005 in the Korean Intellectual Property Office, the entire content of which is incorporated herein by reference.

BACKGROUND OF THE INVENTION

1. Field of the Invention

The present invention relates to an organic electroluminescent display device, and more particularly, to a pixel circuit of an organic electroluminescent display device and a method of driving the same.

2. Description of the Related Art

An organic electroluminescent display device (or organic light emitting diode display device) is a flat panel display device that electrically excites an organic material (e.g., phosphorous organic compounds) to emit light. In an active matrix organic electroluminescent display device, a capacitor stores a voltage for representing a predetermined gray level, and the stored voltage is applied to a pixel for the entire duration of a frame. Based on the type of signal applied for storing the voltage in the capacitor, the active matrix organic electroluminescent display device can be classified into an active matrix organic electroluminescent display device using a voltage programming method or an active matrix organic electroluminescent display device using a current programming method.

Unlike a liquid crystal display (LCD) using voltage driven liquid crystal, the organic electroluminescent display device using the current programming method employs a current driven organic light emitting diode (OLED: also referred to as "an organic EL diode"). Therefore, the organic electroluminescent display device emits light at a luminance controlled by a driving current. Further, the organic electroluminescent display device includes a pixel circuit to generate the driving current.

FIG. 1 is a circuit diagram of a pixel circuit of a conventional organic electroluminescent display device, and FIG. 2 is a timing diagram for driving the pixel circuit of FIG. 1.

Referring to FIG. 1, the conventional pixel circuit includes first, second, third, and fourth transistors M1, M2, M3 and M4, first and second capacitors C1 and C2, and an organic EL diode OLED.

The first transistor M1 controls a current flowing to a drain thereof according to a voltage applied between a gate and a source thereof. The second transistor M2 applies a data voltage to the first capacitor C1 in response to a selection signal supplied from a scan line Sn.

The third transistor M3 connects the first transistor M1 to function as a diode in response to a selection signal supplied from a scan line AZn. The fourth transistor M4 transmits a driving current from the first transistor M1 to the organic EL diode OLED in response to a selection signal from a scan line AZBn.

The first capacitor C1 is connected between the gate of the first transistor M1 and a drain of the second transistor M2, and a second capacitor C2 is connected between the gate and the source of the first transistor M1.

Hereinafter, an operation of the conventional pixel circuit of FIG. 1 will be described in more detail with reference to FIG. 2.

First, when the third transistor M3 is turned on by the selection signal from the scan line AZn, the first transistor M1 is diode-connected, so that a voltage VDD−|Vth| is at a node N at which the first capacitor C1 and the second capacitor C2 are connected.

Then, when the third transistor M3 is turned off and a data voltage Vdata is applied, the voltage at the node N changes by as much as a variation ΔV=VDD−Vdata in the data voltage applied in the first capacitor C1. Therefore, the voltage at the node N changes into VDD−|Vth|−ΔV.

Then, when the selection signal from the scan line AZBn is applied, the fourth transistor M4 is turned on so that a driving current flows to the organic EL diode OLED.

The driving current $I_{OLED}$ flowing to the organic EL diode OLED can be obtained by the following Equation 1:

$$I_{OLED}=k(Vgs-|Vth|)^2=k(VDD-VDD+|Vth|+VDD-Vdata-|Vth|)^2=k(VDD-Vdata)^2 \quad \text{[Equation 1]}$$

Here, VDD is a power supply voltage, Vth is a threshold voltage of the first transistor M1, and Vdata is the data voltage.

As shown in Equation 1, the above described conventional pixel circuit includes the first and second capacitors C1 and C2, and the third and fourth transistors M3 and M4, to compensate for a difference in threshold voltages of first transistors M1.

However, because the conventional pixel circuit needs three different scan lines Sn, AZn, and AZBn, the pixel circuit and the driving circuit are complicated and an aperture ratio of a light emitting display device including the pixel circuit is low.

Further, while one pixel is selected, the data is programmed in the conventional pixel after the difference in the threshold voltage is compensated for. Thus, a charging problem (or delay) makes it difficult to apply the conventional pixel circuit to a high-resolution panel.

Further, in the conventional pixel circuit, the driving current $I_{OLED}$ is controlled by adjusting the power supply voltage VDD and the data voltage Vdata, but a pixel close to the power supply voltage VDD and a pixel far from the power supply voltage VDD have different voltage drops (IR-drops) of the power supply voltage VDD. Therefore, even though substantially the same data voltage Vdata may be applied to the pixels, the luminance may still be non-uniform.

Also, the power supply voltage VDD for driving the conventional pixel circuit should be smaller than or equal to a maximum gray level voltage of the data voltage Vdata. In general, the data voltage Vdata has the maximum gray level voltage (or a black data voltage) of about 5V, so that the power supply voltage VDD should not be higher than 5V. Therefore, a reference voltage VSS needs to have a negative voltage (about −6V) to maintain a voltage difference of 11V between the power supply voltage VDD and the reference voltage VSS. This voltage difference reduces the efficiency of a DC-DC converter supplying the power supply voltage VDD and the reference voltage VSS.

As such, it may be desirable to design a new pixel circuit to address the foregoing problems.

SUMMARY OF THE INVENTION

An aspect of the present invention provides a pixel circuit of an organic electroluminescent display device and a method of driving the same in which a difference in threshold voltages Vth between driving transistors is compensated, and a difference in voltage drops (IR-drops) of a power supply voltage is compensated, thereby generating uniform luminance.

Also, an aspect of the present invention provides a pixel circuit of an organic electroluminescent display device and a method of driving the same in which ranges of a power supply voltage and a reference voltage are capable of being freely controlled independent of a data voltage.

In an exemplary embodiment of the present invention, a pixel circuit of an organic electroluminescent display device includes: an organic EL diode connected to a source of a reference voltage and adapted to emit light at a luminance corresponding to an applied driving current; a driving transistor connected between a source of a power supply voltage and the organic EL diode and adapted to output the driving current corresponding to a voltage applied to a gate of the driving transistor; a threshold voltage compensation transistor connected between the gate and a drain of the driving transistor and adapted to electrically connect the gate and the drain of the driving transistor in response to a scan signal applied to a gate of the threshold voltage compensation transistor; a capacitor having a first electrode connected to the gate of the driving transistor and adapted to maintain a gate voltage of the driving transistor for a period of time; a switching transistor connected between a second electrode of the capacitor and a data line and adapted to apply a data voltage from the data line to the second electrode of the capacitor in response to the scan signal applied to a gate of the switching transistor; an emission control transistor connected between the driving transistor and the organic EL diode and adapted to transmit or cut off the driving current in response to a current emission control signal applied to a gate of the emission control transistor; and a compensation voltage applying transistor connected between a source of a compensation voltage and the second electrode of the capacitor and adapted to transmit the compensation voltage to the second electrode of the capacitor in response to a previous emission control signal applied to a gate of the compensation voltage applying transistor.

In another exemplary embodiment of the present invention, a method of driving a pixel circuit of a organic electroluminescent display device includes: initializing a voltage applied to a first electrode of a capacitor in response to a scan signal and a current emission control signal; programming data by applying a data voltage to a second electrode of the capacitor in response to the scan signal; electrically connecting a gate and a drain of the driving transistor in response to the scan signal; applying the compensation voltage to the second electrode of the capacitor in response to a previous emission control signal; and cutting off the compensation voltage while initializing the voltage applied to the first electrode of the capacitor in response to the previous emission control signal.

In still another exemplary embodiment of the present invention, a pixel circuit of an organic electroluminescent display device includes: an organic EL diode connected to a source of a reference voltage and adapted to emit light according to an applied driving current; a driving transistor connected between a source of a power supply voltage and the organic EL diode and adapted to generate the driving current in response to a voltage applied to a gate of the driving transistor; a threshold voltage compensation transistor connected between the gate and a drain of the driving transistor and adapted to electrically connect the gate and the drain of the driving transistor in response to a scan signal applied to a gate of the threshold voltage compensation transistor; a capacitor having a first electrode and a second electrode, the first electrode of the capacitor being connected to the gate of the driving transistor and maintaining a gate voltage of the driving transistor for a period of time; a switching transistor connected between the second electrode of the capacitor and a data line, and adapted to apply a data voltage from the data line to the second electrode of the capacitor in response to the scan signal applied to a gate of the switching transistor; an emission control transistor connected between the driving transistor and the organic EL diode, and adapted to transmit or cut off the driving current in response to an emission control signal applied to a gate of the emission control transistor; and a compensation voltage applying transistor connected between a source of a compensation voltage and the second electrode of the capacitor, and adapted to transmit the compensation voltage to the second electrode of the capacitor in response to the emission control signal applied to a gate of the compensation voltage applying transistor.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

First Exemplary Embodiment

Figure 1:
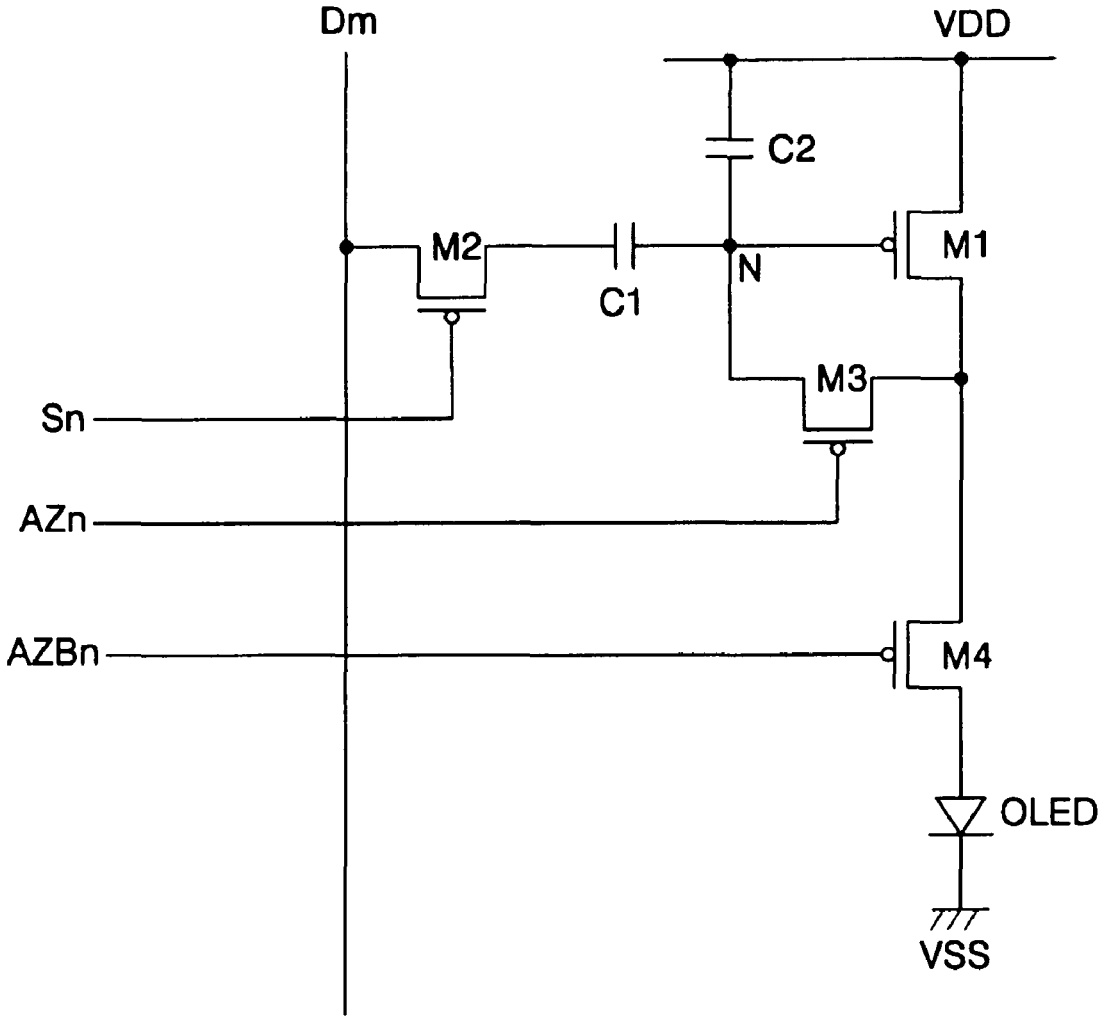
FIG. 1 (PRIOR ART)
FIG. 1 is a circuit diagram of a pixel circuit of a conventional organic electroluminescent display device.
Figure 2:
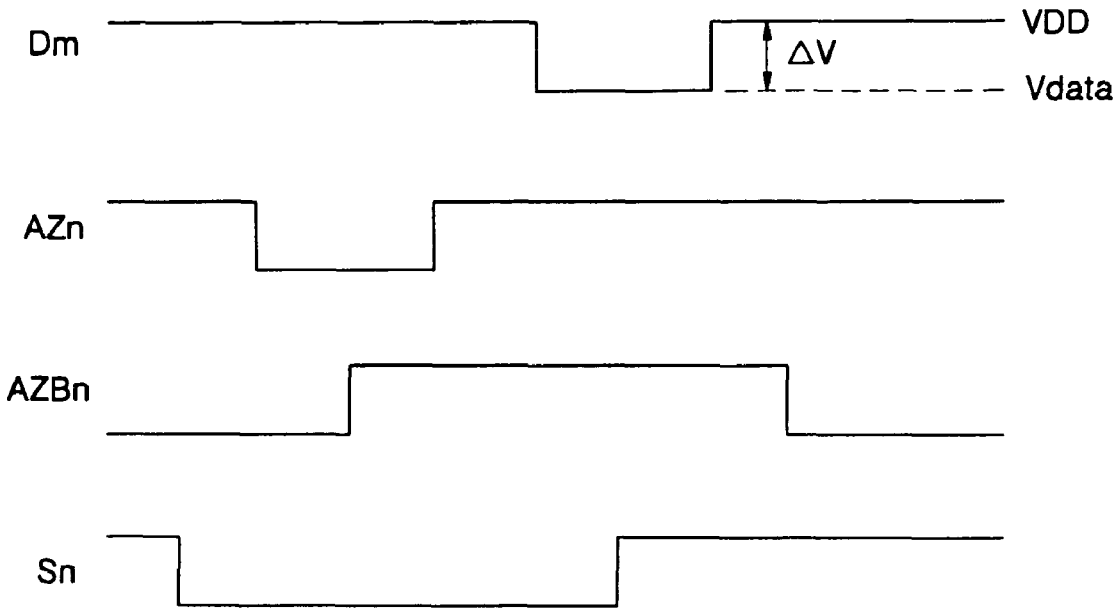
FIG. 2 (PRIOR ART)
FIG. 2 is a timing diagram for driving the pixel circuit of FIG. 1.
Figure 3:
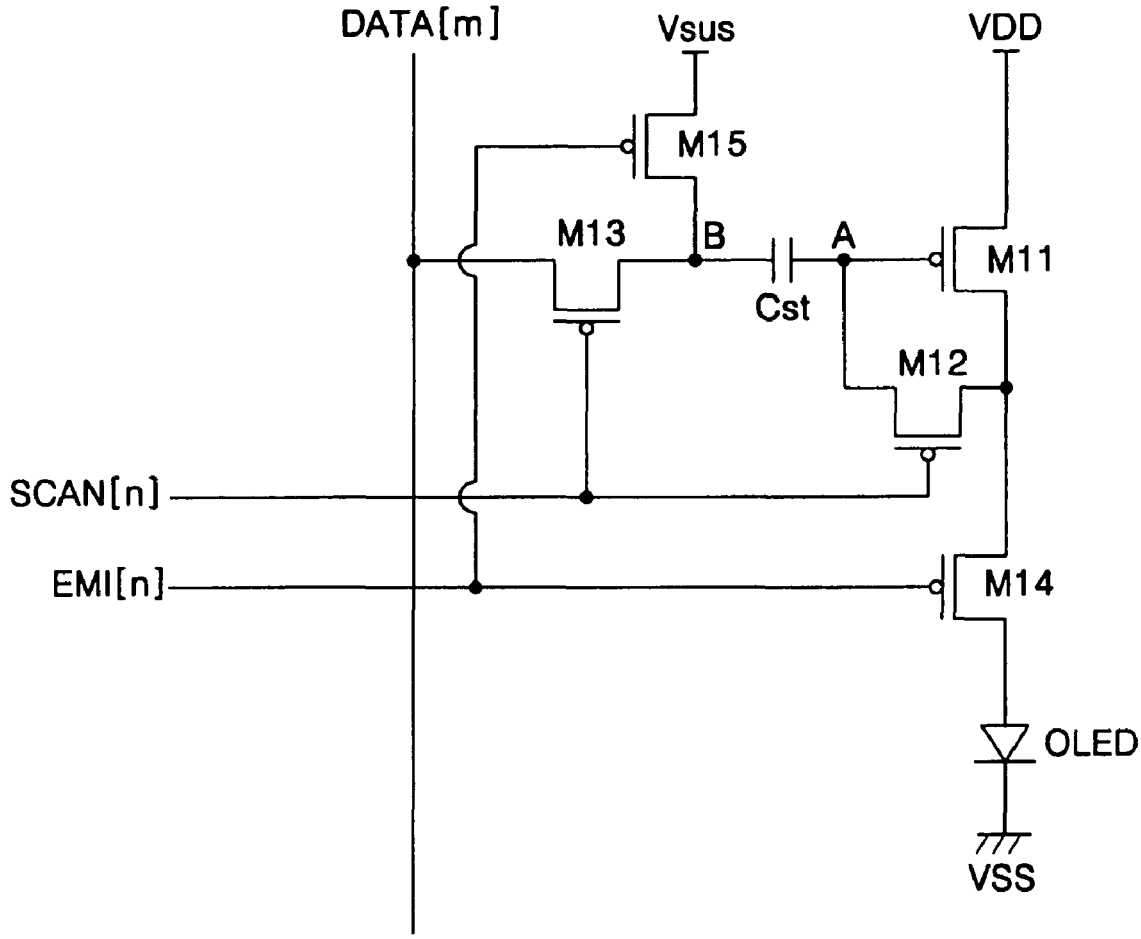
FIG. 3 is a circuit diagram of a pixel circuit of an organic electroluminescent display device according to a first exemplary embodiment of the present invention.

FIG. 3 is a circuit diagram of a pixel circuit of an organic electroluminescent display device according to a first exemplary embodiment of the present invention.

Referring to FIG. 3, the pixel circuit according to the first exemplary embodiment of the present invention includes first, second, third, fourth, and fifth transistors M11, M12, M13, M14 and M15, a capacitor Cst, and an organic EL diode OLED. In FIG. 3, the first, second, third, fourth, and fifth transistors M11, M12, M13, M14 and M15 are shown as P-channel metal oxide semiconductor field effect transistors (MOSFETs), but the present invention is not limited to any one kind of transistor (or carrier type); e.g., alternatively, the first, second, third, fourth, and fifth transistors may be N-channel MOSFETs.

The first (or driving) transistor M11 is connected between a power supply voltage VDD and the organic EL diode OLED and controls a driving current flowing in the organic EL diode OLED according to a voltage applied to a gate thereof. In more detail, the driving transistor M11 includes a source connected to the power supply voltage (or a source of the power supply voltage) VDD, a drain connected to an anode of the organic EL diode OLED through the fourth (or emission control) transistor M14, and the gate connected to a first electrode A of the capacitor Cst. Further, a second electrode B of the capacitor Cst is connected to a drain of the third (or switching) transistor M13.

The organic EL diode OLED has a cathode connected to a reference voltage (or a source of the reference voltage) VSS. Here, the reference voltage VSS is equal to a ground voltage and/or lower than the power supply voltage VDD.

The second (or threshold voltage compensation) transistor M12 is connected between the gate and the drain of the driving transistor M11. Here, the threshold voltage compensation transistor M12 includes a gate connected to a scan line SCAN[n] and is turned on by a selection signal from the scan line SCAN[n], thereby connecting the driving transistor M11 as a diode (or electrically connecting the gate and the drain of the driving transistor M11 with each other).

The switching transistor M13 is connected between a data line DATA[m] and the second electrode B of the capacitor Cst. The switching transistor M13 includes a gate connected to the scan line SCAN[n] (like the gate of the threshold voltage compensation transistor M12), and is turned on by the selection signal from the scan line SCAN[n], thereby applying a data voltage Vdata from the data line DATA[m] to the second electrode B of the capacitor Cst.

The emission control transistor M14 is connected between the drain of the driving transistor M11 and the organic EL diode OLED. The emission control transistor M14 includes a gate connected to an emission control line EMI[n], and transmits/cuts off the driving current from the driving transistor M11 to the organic EL diode OLED in response to an emission control signal from the emission control line EMI[n].

The fifth (or compensation voltage applying) transistor M15 is connected between a compensation voltage (or a source of the compensation voltage) Vsus and the second electrode B of the capacitor Cst. The compensation voltage applying transistor M15 includes a gate connected to the emission control line EMI[n] (like the gate of the emission control transistor M14) and transmits the compensation voltage Vsus to the second electrode B of the capacitor Cst in response to the emission control signal from the emission control line EMI[n]. Here, the compensation voltage Vsus is substantially equal to a black data voltage (or a maximum gray level voltage of a data voltage Vdata).

Hereinafter, an operation of the pixel circuit according to the first exemplary embodiment of the present invention will be described in more detail.

Figure 4:
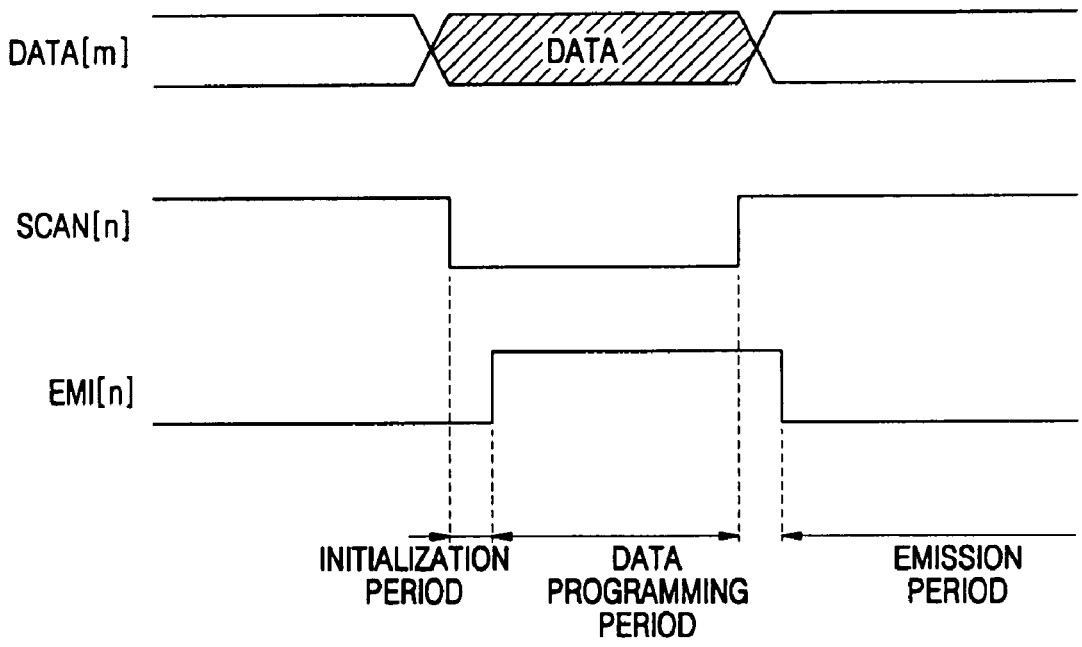
FIG. 4 is a timing diagram for driving the pixel circuit according to the first exemplary embodiment of the present invention.

FIG. 4 is a timing diagram for driving the pixel circuit according to the first exemplary embodiment of the present invention.

Referring to FIG. 4, in an initialization period, when a scan signal with a low level (or a logic low) is applied from the scan line SCAN[n] and an emission control signal with a low level is applied from the emission control line EMI[n], the threshold voltage compensation transistor M12, the switching transistor M13, the emission control transistor M14, and the compensation voltage applying transistor M15 are turned on. Therefore, the voltage stored in the capacitor Cst in a previous frame is initialized through the threshold voltage compensation transistor M12 and the emission control transistor M14.

Then, in a data programming period, when the low-level scan signal is continuously applied from the scan line SCAN [n] and a high-level (or a logic high) emission control signal is applied from the emission control line EMI[n], the threshold voltage compensation transistor M12 and the switching transistor M13 are turned on and the emission control transistor M14 and the compensation voltage applying transistor M15 are turned off. Therefore, the driving transistor M11 is diode-connected (or the gate and the drain of the driving transistor M11 are electrically connected with each other), and a voltage VDD−|Vth| corresponding to a difference between the power supply voltage VDD and the threshold voltage of the driving transistor M11 is applied to the first electrode A of the capacitor Cst. Further, the data voltage Vdata is applied to the second electrode B of the capacitor Cst through the switching transistor M13.

In an emission period, when a high-level scan signal is applied from the scan line SCAN[n] and a low-level emission control signal is applied from the emission control line EMI [n], the threshold voltage compensation transistor M12 and the switching transistor M13 are turned off and the emission control transistor M14 and the compensation voltage applying transistor M15 are turned on. Thus, the compensation voltage Vsus is applied to the second electrode B of the capacitor Cst so that the voltage applied to the first electrode A of the capacitor Cst changes by as much as a variation ΔV=Vdata−Vsus in the voltage applied to the second electrode B of the capacitor Cst. Therefore, the voltage $V_A$ applied to the first electrode A of the capacitor Cst can be obtained by the following Equation 2:

$$V_A = VDD - |Vth| - \Delta V = VDD - |Vth| - Vdata + Vsus \quad \text{[Equation 2]}$$

The voltage obtained by Equation 2 is used as a gate voltage of the driving transistor M1.

Therefore, a driving current corresponding to a voltage difference between the source and the gate of the driving transistor M11 flows to the organic EL diode OLED. Here, the driving current flowing in the organic EL diode OLED can be obtained by the following Equation 3:

$$\begin{aligned} I_{OLED} &= (k(Vsg - |Vth|))^2 \\ &= k(VDD - VDD + |Vth| + Vdata - Vsus - |Vth|)^2 \\ &= k(Vdata - Vsus)^2 \end{aligned} \quad \text{[Equation 3]}$$

Referring to Equation 3, in the pixel circuit according to the first exemplary embodiment of the present invention, the driving current $I_{OLED}$ flowing in the organic EL diode OLED is not affected by the threshold voltage Vth of the driving transistor M11, and thus a threshold voltage difference between driving transistors M11 provided in respective pixel circuits can be compensated.

Further, the pixel circuit can compensate for a difference in the voltage drop of the power supply voltage VDD by applying the compensation voltage Vsus through the compensation voltage applying transistor M15. As shown in Equation 3, the driving current $I_{OLED}$ flowing in the organic EL diode OLED is affected by the compensation voltage Vsus, but, as shown in FIGS. 3 and 4, the pixel circuit does not form a current path through the compensation voltage Vsus. Therefore, there is no voltage drop in a line for supplying the compensation voltage Vsus. Thus, substantially the same compensation voltage Vsus can be applied to all pixels. Further, the data voltage Vdata is controlled so that a desired driving current $I_{OLED}$ flows in the organic EL diode OLED.

In addition, the driving current $I_{OLED}$ of the pixel circuit according to the first exemplary embodiment of the present invention is not affected by the power supply voltage VDD, so that the power supply voltage VDD and the reference voltage VSS can be set independently of the data voltage Vdata. In one embodiment, the power supply voltage VDD is set independently of the data voltage Vdata. Therefore, each of the power supply voltage VDD and the reference voltage VSS can be set to have a positive voltage (or a non-negative voltage) ranging from 0 to 11V. Accordingly, the efficiency of the DC-DC converter supplying the power supply voltage VDD and the reference voltage VSS can be enhanced.

Figure 5:
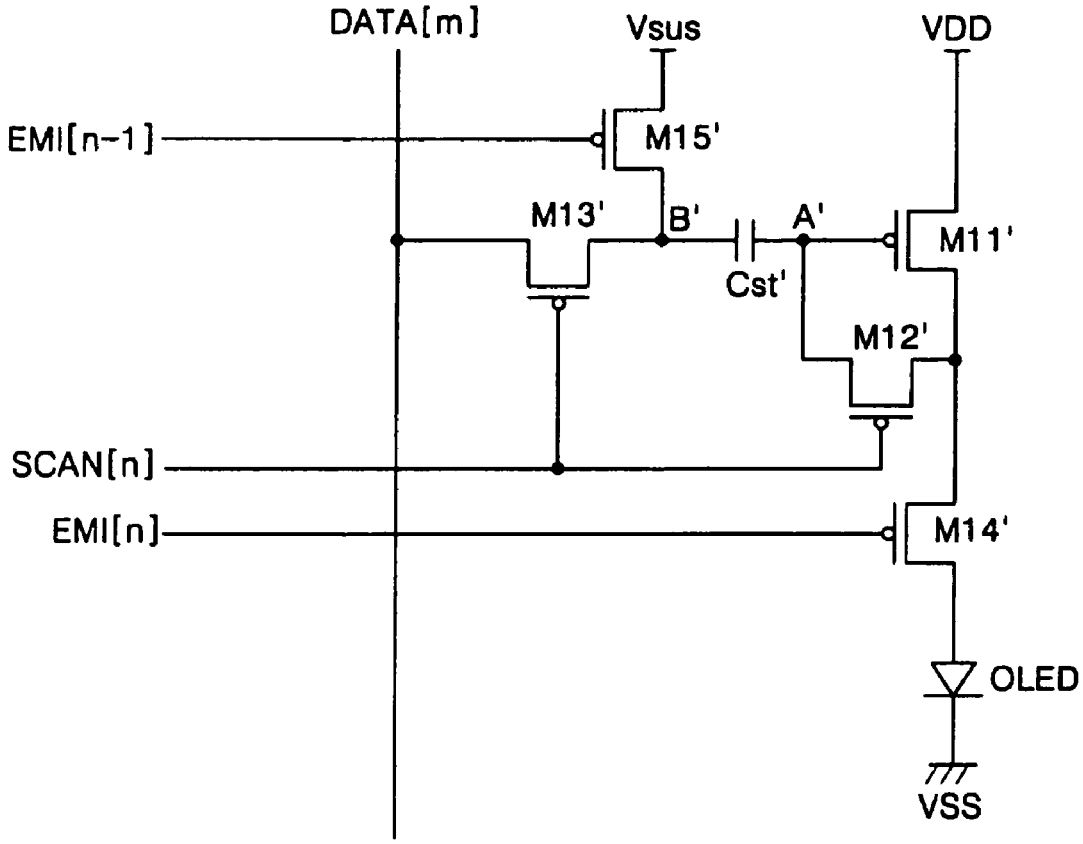
FIG. 5 is a circuit diagram of a pixel circuit of an organic electroluminescent display device according to a second exemplary embodiment of the present invention.

Further, as can be seen from FIGS. 4 and 5, in the emission period of the pixel circuit, the compensation voltage Vsus is applied (or consistently applied) to the second electrode B of the capacitor Cst through the compensation voltage applying transistor M15, so that the gate voltage of the driving transistor M11 is not affected by an off current generated when the switching transistor M13 is turned off, thereby reducing (or preventing) crosstalk.

However, in the pixel circuit according to the first exemplary embodiment of the present invention, the switching transistor M13 and the compensation voltage applying transistor M15 are both turned on in the initialization period, such that the source of the data voltage Vdata and the source of the compensation voltage Vsus are shorted with each other (or electrically connected with each other). This shorting phenomenon not only affects the data voltage Vdata but can also form a current path between the data line DATA[m] and the compensation voltage line for supplying the compensation voltage Vsus, thereby affecting a driver integrated circuit (IC) for applying the data voltage Vdata.

A pixel circuit according to a second exemplary embodiment of the present invention will now be described in more detail to address the shorting phenomenon in the initialization period of the pixel circuit according to the first exemplary embodiment. Second exemplary embodiment FIG. 5 is a circuit diagram of a pixel circuit of an organic electroluminescent display device according to a second exemplary embodiment of the present invention.

Referring to FIG. 5, the pixel circuit according to the second exemplary embodiment of the present invention includes first, second, third, fourth, and fifth transistors M11', M12', M13', M14' and M15', a capacitor Cst', and an organic EL diode OLED.

As compared with the transistors M11, M12, M13, M14 and M15 and the capacitor Cst of the first exemplary embodiment, the fifth (or compensation voltage applying) transistor M15' includes a gate connected not to an emission control line EMI[n] (as is for the fifth transistor M15) but to an emission control line EMI[n−1]. Therefore, the compensation voltage Vsus is transmitted in response to a previous emission control signal from the emission control line EMI[n−1].

Hereinafter, an operation of the pixel circuit according to the second exemplary embodiment of the present invention will be described in more detail.

Figure 6:
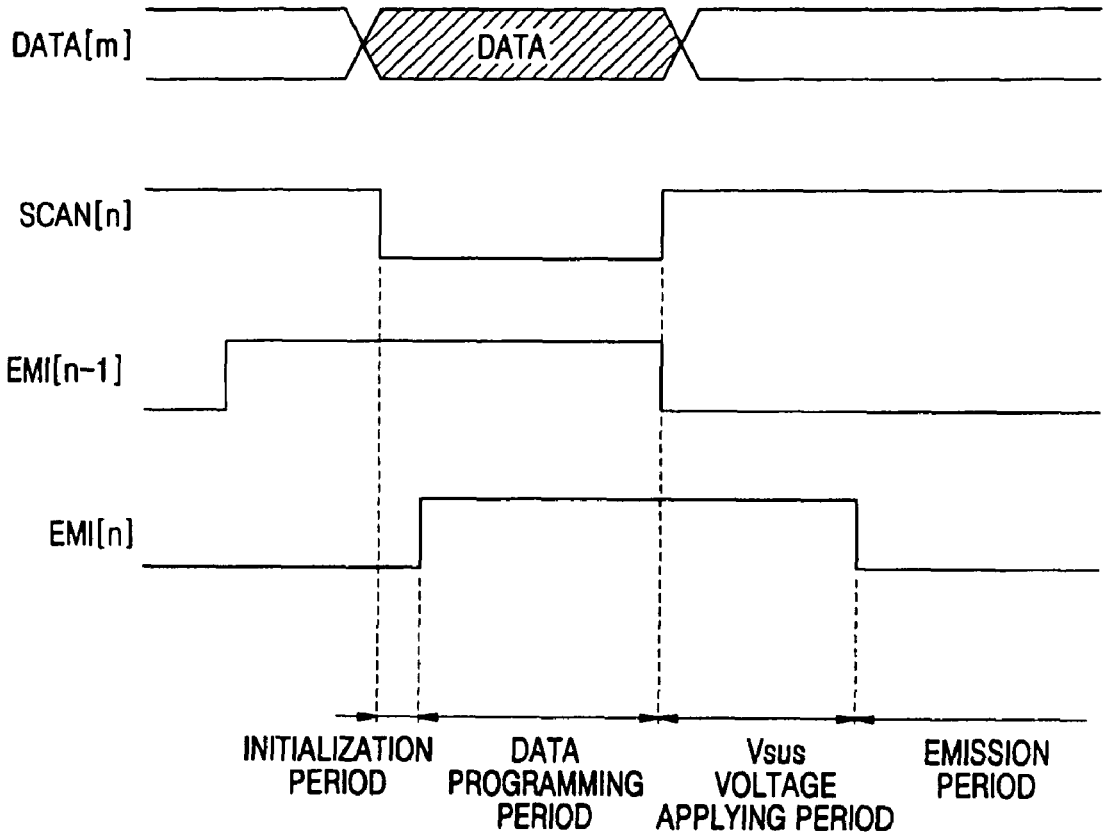
FIG. 6 is a timing diagram for driving the pixel circuit according to the second exemplary embodiment of the present invention.

FIG. 6 is a timing diagram for driving the pixel circuit according to the second exemplary embodiment of the present invention.

Referring to FIGS. 5 and 6, in an initialization period, when a low-level scan signal is applied from a scan line SCAN[n], a high-level previous emission control signal is applied from an emission control line EMI[n−1], and a low-level current emission control signal is applied from an emission control line EMI[n], the second (or threshold voltage compensation) transistor M12', the third (or switching) transistor M13', and the fourth (or emission control) transistor M14' are turned on. Therefore, the voltage stored in the capacitor Cst' in a previous frame is initialized through the threshold voltage compensation transistor M12' and the emission control transistor M14'.

Unlike the first exemplary embodiment, in the pixel circuit according to the second exemplary embodiment of the present invention, the compensation voltage applying transistor M15' is turned off in the initialization period, so that the compensation voltage Vsus is not supplied to the second electrode B of the capacitor Cst. Therefore, the shorting phenomenon of the pixel circuit according to the first exemplary embodiment of the present invention is prevented. That is, the switching transistor M12' and the compensation voltage applying transistor M15' are not both turned on in the initialization period, so that a source of the data voltage Vdata and a source of the compensation voltage Vsus are not shorted with each other.

Then, in a data programming period, when the low-level scan signal is continuously applied from the scan line SCAN[n], the high-level previous emission control signal is applied from the emission control line EMI[n−1], and a high-level current emission control signal is applied from the emission control line EMI[n], the threshold voltage compensation transistor M12' and the switching transistor M13' are turned on, but the emission control transistor M14' and the compensation voltage applying transistor M15' are turned off. Therefore, the driving transistor M11' is diode-connected, and a voltage VDD−|Vth| corresponding to a difference between the power supply voltage VDD and the threshold voltage of the driving transistor M11' is applied to a first electrode A' of the capacitor Cst'. Further, the data voltage Vdata is applied to a second electrode B' of the capacitor Cst' through the switching transistor M13'.

Then, in a period of applying the compensation voltage Vsus, when a high-level scan signal is applied from the scan line SCAN[n], a low-level previous emission control signal is applied from the emission control line EMI[n−1], and a high-level current emission control signal is applied from the emission control line EMI[n], the threshold voltage compensation transistor M12', the switching transistor M13', and the emission control transistor M14' are turned off, but the compensation voltage applying transistor M15' is turned on. Thus, the compensation voltage Vsus is applied to the second electrode B' of the capacitor Cst', so that the voltage applied to the first electrode A' of the capacitor Cst' changes by as much as a variation ΔV=Vdata−Vsus in the voltage applied to the second electrode B' of the capacitor Cst'. Here, the voltage $V_A$ applied to the first electrode A' of the capacitor Cst' is given by Equation 2.

In an emission period, when a high-level scan signal is applied from the scan line SCAN[n], a low-level previous emission control signal is applied from the emission control line EMI[n−1], and a low-level current emission control signal is applied from the emission control line EMI[n], the emission control transistor M14' is turned on.

Therefore, a driving current corresponding to a voltage difference between the source and the gate of the driving transistor M11' flows to the organic EL diode OLED. Here, the driving current flowing in the organic EL diode OLED is given by Equation 3.

As shown in Equation 3, the compensation voltage Vsus is substantially equal to the black data voltage. Therefore, as an example, when the black data voltage is 1V, the compensation voltage Vsus is set to be 1V.

In one embodiment, both the power supply voltage VDD and the reference voltage VSS have positive voltages (or non-negative voltages) to enhance the efficiency of a DC-DC converter (or converters) for supplying these voltages. For example, when the power supply voltage VDD is about 11V, the reference voltage VSS can be set to be about 0V.

Unlike the pixel circuit according to the first exemplary embodiment of the present invention, the pixel circuit according to the second embodiment of the present invention not only compensates for a difference in threshold voltages Vth, compensates for IR-drops due to voltage drops of the power supply voltage VDD using the compensation voltage Vsus, increases the efficiency of the DC-DC converter, and reduces (or prevents) crosstalk, and sets each of the power supply voltage VDD and the reference voltage VSS to have a positive voltage (or non-negative voltage) ranging from 0 to 11V, but also ensures that the switching transistor M13' and the compensation voltage applying transistor M15' are not turned on at the same time in the initialization period, thereby blocking (or preventing) the source of the data voltage Vdata and the source of the compensation voltage Vsus from being shorted with each other.

As described above, a driving current flowing in an organic EL diode according to an embodiment of the present invention is not affected by the threshold voltage of a driving transistor, thereby compensating for a difference in threshold voltages between pixel circuits.

Further, the driving current flowing in the organic EL diode depends on a compensation voltage and is not affected by a power supply voltage, thereby compensating for a difference in voltage drops (IR-drops) of a power supply voltage between pixel circuits.

Also, the driving current for the pixel circuit is not affected by the power supply voltage, so that the power supply voltage and/or a reference voltage (particularly, the power supply voltage) are not affected by a data voltage while they are set. Therefore, the power supply voltage and/or the reference voltage may be set to have a positive voltage range, thereby increasing the efficiency of a power supplying DC-DC converter for supping the power supply voltage and/or the reference voltage.

Additionally, in the pixel circuit, the compensation voltage is applied to a second electrode of a capacitor in an emission period, so that a gate voltage of the driving transistor is not affected even when off current is generated with a switching transistor turned off, thereby reducing (or preventing) crosstalk.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A pixel circuit of an organic electroluminescent (EL) display device comprising a plurality of pixels and a plurality of emission lines connected to the pixels, the pixel circuit comprising:

an organic EL diode connected to a source of a reference voltage and adapted to emit light at a luminance corresponding to an applied driving current;

a driving transistor connected between a source of a power supply voltage and the organic EL diode and adapted to output the driving current corresponding to a voltage applied to a gate of the driving transistor;

a threshold voltage compensation transistor connected between the gate and a drain of the driving transistor and adapted to electrically connect the gate and the drain of the driving transistor in response to a scan signal applied to a gate of the threshold voltage compensation transistor;

a capacitor having a first electrode connected to the gate of the driving transistor and adapted to maintain a gate voltage of the driving transistor for a period of time;

a switching transistor connected between a second electrode of the capacitor and a data line and adapted to apply a data voltage from the data line to the second electrode of the capacitor in response to the scan signal applied to a gate of the switching transistor;

an emission control transistor connected between the driving transistor and the organic EL diode and adapted to transmit or cut off the driving current in response to a current emission control signal applied to a gate of the emission control transistor; and a compensation voltage applying transistor connected between a source of a compensation voltage and the second electrode of the capacitor and adapted to transmit the compensation voltage to the second electrode of the capacitor in response to a previous emission control signal applied to a gate of the compensation voltage applying transistor;

wherein the previous emission control signal is an emission control signal of a previous one of the pixels.

2. The pixel circuit according to claim 1, wherein the compensation voltage applying transistor is turned off in an initialization period of the pixel circuit.

3. The pixel circuit according to claim 2, wherein the compensation voltage is substantially equal to a black data voltage.

4. The pixel circuit according to claim 1, wherein the threshold voltage compensation transistor and the switching transistor are switched in response to the same scan signal.

5. The pixel circuit according to claim 1, wherein both the power supply voltage and the reference voltage are non-negative power supply voltages.

6. The pixel circuit according to claim 1, wherein the driving transistor, the threshold voltage compensation transistor, the switching transistor, the emission control transistor, and the compensation voltage applying transistor are of a same carrier type MOSFETs.

7. The pixel circuit according to claim 1, wherein the compensation voltage applying transistor is turned off and the switching transistor is turned on in an initialization period of the pixel circuit to prevent a short circuit.

8. The pixel circuit according to claim 1, wherein the previous emission control signal is from a first emission control line and the current emission control signal is from a second emission control line differing from the first emission control line.

9. A method of driving the pixel circuit of an organic electroluminescent display comprising a plurality of pixels and a plurality of emission lines connected to the pixels, the method comprising:

initializing a voltage applied to a first electrode of a capacitor in response to a scan signal and a current emission control signal;

applying a data voltage to a second electrode of the capacitor in response to the scan signal;

connecting a driving transistor to function as a diode in response to the scan signal;

applying a compensation voltage to the second electrode of the capacitor in response to a previous emission control signal;

cutting off the compensation voltage while initializing a voltage applied to the first electrode of the capacitor; and transmitting or cutting off a driving current between the driving transistor and an organic EL diode in response to the current emission control signal, wherein the previous emission control signal is an emission control signal of a previous one of the pixels.

10. The method according to claim 9, further comprising controlling an organic EL diode to emit light in response to the current emission control signal after the applying of the compensation voltage.

11. The method according to claim 10, wherein the compensation voltage is substantially equal to a black data voltage.

12. The method according to claim 11, wherein in the applying of the compensation voltage, a voltage VA applied to the first electrode of the capacitor Cst can be obtained by:

$$VA=VDD-|Vth|-V\text{data}+Vsus$$

where VDD is the power supply voltage, Vth is a threshold voltage of the driving transistor, Vdata is the data voltage, and Vsus is the compensation voltage.

13. The method according to claim 9, further comprising cutting off the compensation voltage in response to the previous emission control signal.

* * * * *